US012692208B2

(12) United States Patent
Masse

(10) Patent No.: US 12,692,208 B2
(45) Date of Patent: Jul. 28, 2026

(54) REDUCED VAPOR-TOXICITY HYDRAZINE COMPOSITION

(71) Applicant: AEROJET ROCKETDYNE, INC., Sacramento, CA (US)

(72) Inventor: Robert K. Masse, Redmond, WA (US)

(73) Assignee: AEROJET ROCKETDYNE, INC., Melbourne, FL (US)

( * ) Notice: Subject to any disclaimer, the term of this patent is extended or adjusted under 35 U.S.C. 154(b) by 1317 days.

(21) Appl. No.: 17/311,411

(22) PCT Filed: Jan. 24, 2019

(86) PCT No.: PCT/US2019/014900

§ 371 (c)(1),
(2) Date: Jun. 7, 2021

(87) PCT Pub. No.: WO2020/153958

PCT Pub. Date: Jul. 30, 2020

(65) Prior Publication Data

US 2022/0024836 A1 Jan. 27, 2022

(51) Int. Cl.
*C06B 47/08* (2006.01)

(52) U.S. Cl.
CPC ..... *C06B 47/08* (2013.01)

(58) Field of Classification Search
None
See application file for complete search history.

(56) References Cited

U.S. PATENT DOCUMENTS

| | | | | |
|---|---|---|---|---|
| 2,940,843 | A | 6/1960 | Wilson et al. | |
| 2,951,335 | A | 9/1960 | Stengel | |
| 3,088,272 | A | 5/1963 | Stengel et al. | |
| 3,164,505 | A | 1/1965 | Hsieh et al. | |
| 3,171,249 | A | 3/1965 | Bell | |
| 3,419,443 | A | 12/1968 | Maes | |
| 3,658,609 | A | 4/1972 | Lum et al. | |
| 3,953,261 | A | 4/1976 | Duncan et al. | |
| 3,953,262 | A | 4/1976 | Duncan et al. | |
| 5,223,057 | A * | 6/1993 | Mueller | C06B 31/00 149/46 |
| 5,485,722 | A | 1/1996 | Schmidt et al. | |
| 7,976,653 | B2 | 7/2011 | Anflo et al. | |
| 2012/0304620 | A1* | 12/2012 | Masse | B01J 23/468 60/264 |

OTHER PUBLICATIONS

Keshavarz, M.H., Ramadan, A., Mousaviazar, A., Zali, A., Esmaeilpour, K., Atabaki, F. and Shkrolahi, A. (2011). Reducing dangerous effects of unsymmetrical dimethylhydrazine as a liquid propellant by addition of hydroxyethylhydrazine—Part I: Physical properties. Journal of Energetic Materials. vol. 29(1). pp. 46-60. Retrieved from: https://www.tandfonline.com/doi/full/10.1080/07370652.2010.501326.

Keshavarz, M.H., Ramadan, A., Mousaviazar, A., Zali, A., and Shkrolahi, A. (2011). Reducing dangerous effects of unsymmetrical dimethylhydrazine as a liquid propellant by addition of hydroxyethylhydrazine—Part II: Performance with several oxidizers. Journal of Energetic Materials. vol. 29(3). pp. 228-240. Retrieved from: https://www.tandfonline.com/doi/abs/10.1080/07370652.2010.514320.

International Search Report for International Application No. PCT/US2019/014900 completed Sep. 30, 2019.

International Preliminary Report on Patentability for International Application No. PCT/US2019/014900 mailed Aug. 5, 2021.

T. W. Price, D. D. Evans, "The Status of Monopropellant Hydrazine Technology," NASA Technical Report 32-7227, Feb. 15, 1968.

Development of Design and Scaling Criteria for Monopropellant hydrazine Reactors Employing Shell 405 Spontaneous Catalyst, NASA Contract NAS 7-372 Final Report RRC-66-R-76—vol. II.

"Material Compatibility with Space Storable Propellants," report prepared by Martin Marietta for JPL under contract HF-556439, Mar. 1972.

Final Report 67-R-98, "Engine Evaluation for Hydrazine-Hydrazinium Nitrate Catalyst Development Program," Jun. 1967.

NASA Technical Memorandum 33-7Z9, Propellant/Material Compatibility Program and Results, Aug. 1976.

Eckart W. Schmidt and Donald A. Pahl, "Hydrazine Propellant Blend Selection for Advanced Front End Propulsion System," contract FO46II-83-C-0050 Interim Report, Mar. 1985.

D.K. Simpson, "Safety and Handling of Hydrazine," 22nd Department of Defense Explosives Safety Seminar, Aug. 1986.

OAC-94-H-1962, Hydroxylammonium Nitrate (HAN) Based Monopropellant Blends for F 16 EPU Gas Generators, Apr. 1994.

Robert S. Jankovsky, "HAN-Based Monopropellant Assessment for Spacecraft," NASA Technical Memorandum 107287, 32nd Joint AIAA, ASME, SAE, ASEE Propulsion Conference, Lake Buena Vista, Florida, Jul. 1-3, 1996.

Meinhardt, D.S., and Swink, D.G., "Demonstration of a Hydroxylammonium Nitrate Based Attitude Control System Thruster," Primex Aerospace Company Test Report 96-R-2035, Jun. 1996.

(Continued)

*Primary Examiner* — Aileen B Felton

(74) *Attorney, Agent, or Firm* — Carlson, Gaskey & Olds, P.C.

(57) ABSTRACT

The hydrazine-containing composition is a liquid mixture that includes from 5 mol % to 95 mol % of unprotonated hydrazine selected from hydrazine, monomethylhydrazine, dimethylhydrazine, ethylhydrazine, and combinations thereof, and from 5 mol % to 90 mol % of at least one oxygen-containing solute or solvent selected from acetals, acetyls, alcoxyamines having two or more carbon atoms, aldehydes, amides, amides and particularly carboxamides, aminoalcohols, carbazides, semicarbazides, carbon-containing nitrate salts comprising cations with logarithmic dissociation constants less than 9.2, hydroxyalkyl nitro compounds, hydroxyalkylhydrazines, carbonates, carboxylic acids and anhydrides of carboxylic acids, esters, ethers, ketals, ketones, mono- and poly-alcohols in 31% or greater mass fraction, nitrate esters, nitrosamines, sugars, and combinations thereof. The unprotonated hydrazine has a first vapor pressure and the oxygen-containing solvent has a second vapor pressure that is less than the first vapor pressure.

22 Claims, No Drawings

(56) References Cited

OTHER PUBLICATIONS

Beate Ritz, Yingxu Zhao, Anusha Krishnadasan, Nola Kennedy and Hal Morgenstern, "Estimated Effects of Hydrazine Exposure on Cancer Incidence and Mortality in Aerospace Workers," Epidemiology, vol. 17, No. 2, pp. 154-161, Mar. 2006.

Eckart W. Schmidt, L. Bruce Katter, Sock Yoon, Douglas D. Huxtable, and Alan R. Harvey, "Olin Technology Council New Propellant Technology Task 4 Final Report," RRC-930R-1800, Feb. 1994.

Niklas Wingborg, Carina Eldsater, Henrik Skifs, "Formulation and Characterization of and-Based Liquid Monopropellants, Proceedings of the 2nd International Conference on Green Propellants for Space Propulsion," Cagliari, Sardinia, Italy, Jun. 7-8, 2004.

Anflo, K., Moore, S., King, P., "Expanding the ADN-Based Monopropellant Thruster Family," 23rd Annual AIAA/USU Conference on Small Satellites, Aug. 10-13, 2009.

Ronald Spores, Robert Masse, Scott Kimbrel, and Chris McLean, GPIM AF-M315E Propulsion System, 49th AIAA/ASME/SAE/ASEE Joint Propulsion Conference & Exhibit, San Jose California, Jul. 15-17, 2023.

Robert K. Masse and Benjamin A. Glassy, "Low-Vapor-Toxicity Hydrazine Propellant Blends," Joint Meeting of the 49th Combustion (CS), 37th Airbreathing Propulsion (APS), 37th Exhaust Plume and Signatures (EPSS), and 31st Propulsion Systems Hazards (PSHS) Subcommittees; and the 66th JANNAF Propulsion Meeting (JPM) and meeting of the Programmatic and Industrial Base (PIB), Jun. 3 7, 2019.

Vuong, A., Zhu, Z., Pourpoint, T., & Masse, R. (2022). "Hydrazine-based Green Propellant Development, Testing, and Characterization," JANNAF 13th Liquid Propulsion, 12th Spacecraft Propulsion, Joint Subcommittee Meeting Programmatic, and Industrial Base Meeting, Huntsville, Al, Dec. 5-9, 2022.

Robert K. Masse, Benjamin A. Glassy, Ronald A. Spores, Andrew T. Vuong, Zhenghao Zhu, and Timothée L. Pourpoint, "Hydrazine-Based Green Monopropellant Blends," AIAA SciTech Forum, Orlando, Florida, Jan. 8-12, 2024.

Robert K. Masse, Benjamin A. Glassy, Ronald A. Spores, Andrew T. Vuong, Zhenghao Zhu, and Timothée L. Pourpoint, "High-Performance Hydrazine-Based Green Monopropellant Blends," 9th Edition of the Space Propulsion Conference, Glasgow, Scotland, May 20-23, 2024.

Laura A. Chen-Mertens, "End Products of Combustion of a Low Vapor Pressure Hydrazine Blend in a Monopropellant Flow Tube with Mass Spectrometric Detection," JANNAF 13th Liquid Propulsion, 12th Spacecraft Propulsion, Joint Subcommittee Meeting Programmatic, and Industrial Base Meeting, Huntsville, Al, Dec. 5-9, 2023.

E. H. Cardiff, E. A. Beckman, and A. Moreno, "Material Compatibility Testing of Green Hydrazine," 71st JANNAF Propulsion, Programmatic and Industrial Base, 18th Modeling and Simulation, 14th Liquid Propulsion, 13th Spacecraft Propulsion (SPS), and Joint Subcommittee Meeting, Oklahoma City, OK, May 6-9, 2024.

Yanice Benitez, Alejandro L. Briseno, Laura A. Chen-Mertens and Joshua D. Winner, "Characterization of an Ionic Liquid Monopropellant's Chemical Composition," 71st JANNAF Propulsion, Programmatic and Industrial Base, 18th Modeling and Simulation, 14th Liquid Propulsion, 13th Spacecraft Propulsion (SPS), and Joint Subcommittee Meeting, Oklahoma City, OK, May 6-9, 2024.

NASA TechPort—Green Hydrazine Propellant Blend (GHPB-ACO) https://techport.nasa.gov/view/116406.

* cited by examiner

REDUCED VAPOR-TOXICITY HYDRAZINE COMPOSITION

BACKGROUND

Hydrazines are used as rocket propellants and industrial solvents. However, hydrazines generally have a high vapor toxicity, and handling precautions must therefore be taken for safety purposes. Hydrazines have been combined with additives to modify properties such as freezing point, gelling, or propulsive performance. While there has been success in modifying certain properties, efforts have largely failed to reduce vapor toxicity without significantly debiting desirable functional characteristics, such as catalytic behavior and solvent strength.

SUMMARY

A hydrazine-containing composition according to an example of the present disclosure includes a liquid mixture that has from 5 mol % to 95 mol % of unprotonated hydrazine selected from a group consisting of hydrazine, monomethylhydrazine, dimethylhydrazine, ethylhydrazine, and combinations thereof, the unprotonated hydrazine having a first vapor pressure, and from 5 mol % to 90 mol % of at least one oxygen-containing solute or solvent having a second vapor pressure that is less than the first vapor pressure. The at least one oxygen-containing solute or solvent is selected from the group consisting of acetals, acetyls, alcoxyamines having two or more carbon atoms, aldehydes, amides, aminoalcohols, carbazides, semicarbazides, carbon-containing nitrate salts including cations with logarithmic dissociation constants greater than 9.2, hydroxyalkyl nitro compounds, hydroxyalkylhydrazines, carbonates, carboxylic acids and anhydrides of carboxylic acids, esters, ethers, ketals, ketones, mono- and poly-alcohols in 31% or greater mass fraction, nitrate esters, nitrosamines, sugars, and combinations thereof.

In a further embodiment of any of the foregoing embodiments, the at least one oxygen-containing solute or solvent is selected from a group consisting of carbohydrazide nitrate, ethylammonium nitrate, ethylene dihydrazine nitrate, hydroxyethylhydrazine, hydroxyethylhydrazinium nitrate, bis(2-hydroxyethyl)hydrazine, bis(2-hydroxyethyl) hydrazinium nitrate, and combinations thereof.

In a further embodiment of any of the foregoing embodiments, the liquid mixture includes up to 98 mol % water.

In a further embodiment of any of the foregoing embodiments, the liquid mixture includes an oxidizer selected from a group consisting of ammonium nitrate, carbohydrazide nitrate, hydrazinium nitrate, hydroxylammonium nitrate, and combinations thereof.

In a further embodiment of any of the foregoing embodiments, the at least one oxygen-containing solute or solvent is selected from a group consisting of ethylammonium nitrate, hydroxyethylhydrazinium nitrate, and combinations thereof.

In a further embodiment of any of the foregoing embodiments, the liquid mixture includes up to 98 mol % of water.

In a further embodiment of any of the foregoing embodiments, in the liquid mixture includes an oxidizer selected from a group consisting of ammonium nitrate, carbohydrazide nitrate, hydrazinium nitrate, hydroxylammonium nitrate, and combinations thereof.

In a further embodiment of any of the foregoing embodiments, the at least one oxygen-containing solute or solvent is ethylammonium nitrate.

In a further embodiment of any of the foregoing embodiments, the at least one oxygen-containing solute or solvent is hydroxyethylhydrazinium nitrate.

In a further embodiment of any of the foregoing embodiments, the liquid mixture includes up to 98 mol % of water.

In a further embodiment of any of the foregoing embodiments, in the liquid mixture includes an oxidizer.

In a further embodiment of any of the foregoing embodiments, the oxidizer is selected from a group consisting of ammonium nitrate, carbohydrazide nitrate, hydrazinium nitrate, hydroxylammonium nitrate, and combinations thereof.

In a further embodiment of any of the foregoing embodiments, the oxidizer is hydrazinium nitrate.

In a further embodiment of any of the foregoing embodiments, the at least one oxygen-containing solute or solvent is selected from a group consisting of carbohydrazide nitrate, ethylammonium nitrate, ethylene dihydrazine nitrate, hydroxyethylhydrazine, hydroxyethylhydrazinium nitrate, bis(2-hydroxyethyl)hydrazine, bis(2-hydroxyethyl) hydrazinium nitrate, and combinations thereof.

In a further embodiment of any of the foregoing embodiments, the liquid mixture includes up to 98% of water.

In a further embodiment of any of the foregoing embodiments, the liquid mixture has a density of 1.1 grams per cubic centimeter to 1.5 grams per cubic centimeter.

In a further embodiment of any of the foregoing embodiments, the second vapor pressure is less than the first vapor pressure by at least 50%.

A hydrazine-containing composition according to an example of the present disclosure includes a liquid mixture including water, an oxidizer selected from the group consisting of ammonium dinitramide, ammonium nitrate, carbohydrazide nitrate, hydrazinium nitrate, hydroxylammonium nitrate, and combinations thereof, unprotonated hydrazine selected from the group consisting of hydrazine, monomethylhydrazine, dimethylhydrazine, ethylhydrazine, and combinations thereof, and at least one oxygen-containing solute or solvent selected from the group consisting of carbohydrazide nitrate, ethylammonium nitrate, ethylene dihydrazine nitrate, hydroxyethylhydrazine, hydroxyethylhydrazinium nitrate, and combinations thereof.

In a further embodiment of any of the foregoing embodiments, the liquid mixture includes 20 mol % to 80 mol % of the unprotonated hydrazine, 10 mol % to 80 mol % of the oxygen-containing solute or solvent, 0 mol % to 20 mol % of the oxidizer, and 0 mol % to 20 mol % of the water.

In a further embodiment of any of the foregoing embodiments, the oxidizer is hydrazinium nitrate, and the at least one oxygen-containing solute or solvent is selected a group consisting of ethylammonium nitrate and hydroxyethylhydrazinium nitrate, and combinations thereof.

DETAILED DESCRIPTION

Disclosed herein is a low-vapor toxicity liquid hydrazine composition that maintains good performance as a rocket propellant and industrial solvent. Additives have previously been used in combination with hydrazine. However, such additives have not effectively diminished the vapor-toxicity of hydrazines to levels safe for human exposure without also destroying the desirable properties of hydrazine. For instance, such additives often render the mixture to be too dilute or viscous, reduce the chemical activity to ineffective levels, or reduce the storage life to unacceptable levels.

It has now unexpectedly been found, however, that certain oxygen-containing solutes and solvents effectively lower the vapor toxicity of hydrazine while maintaining the functional aspects of hydrazine that make it attractive for use as a rocket propellant or industrial solvent. For instance, strong oxygen-containing solutes and solvents that form azeotropic and/or pseudoazeotropic mixtures with hydrazine and that have lower vapor pressure than hydrazine can be mixed with hydrazine to effectively lower the vapor toxicity while maintaining functionality.

The hydrazine-containing composition is a liquid mixture and includes from 5 mol % to 90 mol % hydrazine selected from hydrazine, monomethylhydrazine, dimethylhydrazine, ethylhydrazine, and combinations thereof, and from 5 mol % to 95 mol % of at least one oxygen-containing solute or solvent selected from acetals, acetyls, alcoxyamines having two or more carbon atoms, aldehydes, amides and particularly carboxamides, aminoalcohols, carbazides and semicarbazides, carbon-containing nitrate salts comprising cations with logarithmic dissociation constants greater than 9.2, hydroxyalkyl nitro compounds, hydroxyalkylhydrazines, carbonates, carboxylic acids and anhydrides of carboxylic acids, esters, ethers, ketals, ketones, mono- and poly-alcohols in 31% or greater mass fraction, nitrate esters, nitrosamines, sugars, and combinations thereof.

The unprotonated hydrazine has a first vapor pressure and the oxygen-containing solute or solvent has a second vapor pressure that is less than the first vapor pressure. Vapor pressure is typically expressed in units of millimeters Hg at a reference temperature of 25° C., but any equivalent units could be used. Lower vapor pressure solute or solvents are preferred, in that the resulting reduction in the hydrazine vapor pressure and vapor toxicity will be generally greater. For instance, a liquid mixture where the second vapor pressure is 90% less than the first vapor pressure will reduce the hydrazine vapor toxicity more than one of equal molar proportions of the hydrazine and solute or solvent where the second vapor pressure is 30% less than the first vapor pressure, where the units of comparison are millimeters Hg at a reference temperature of 25° C. In one example, the second vapor pressure is less than the first vapor pressure by at least 50%.

The unprotonated hydrazine is substantially unprotonated in the liquid mixture. For instance, the oxygen-containing solute or solvent is nonacidic or of basic pH so as to minimize protonization of the hydrazine. In turn, the unprotonization of the hydrazine serves to preserve the catalytic and chemical activity of the hydrazine rather than altering these activities as do other, more acidic, additives.

Example solutes and solvents suitable for use in the liquid mixtures of the present invention are listed as follows:

| | |
|---|---|
| acetals | 1,1-Diethoxypropane, 1,1-Diethoxybutane, |
| acetyls | acetyl nitrate, dimethylacetamide |
| alcoxyamines having two or more carbon atoms | ethoxyamine, ethoxyamine nitrate |
| aldehydes | glutaraldehyde |
| amides and particularly carboxamides | formamide, acetamide, cyanamide, urea |
| aminoalcohols | ethanolamine, diethanolamine |
| carbazides and semicarbazides | carbohydrazide and semicarbohydrazide |
| carbon-containing nitrate salts comprising cations with logarithmic dissociation constants greater than 9.2 | ethylammonium nitrate, hydroxyelthylhydrazinium nitrate, ethylendihydrazine nitrate, carbohydrazide nitrate, semicarbohydrazide nitrate |
| hydroxyalkyl nitro compounds | nitroethanol |
| hydroxyalkylhydrazines | Hydroxyethylhydrazine, bis(2-hydroxyethyl)hydrazine |

-continued

| | |
|---|---|
| carbonates | calcium carbonate, ammonium carbonate, sodium bicarbonate |
| carboxylic acids and anhydrides of carboxylic acids | acetic acid, propionic acid, caproic acid, acetic anhydride |
| esters | Butyl benzoate, butyl glycolate |
| ethers | dibutyl ether, morpholine |
| ketals | 1,7-Dioxaspiro[5.5]undecane |
| ketones | acetophenone, acetylacetone |
| mono- and poly-alcohols in 31% or greater mass fraction | ethylene glycol, glycerine |
| nitrate esters | ethylene glycol nitrate, nitroglycerine |
| nitrosamines | N-Nitrosodimethylamine, N-Nitrosodiethylamine |
| sugars | glucose, fructose, sucrose |

The liquid mixture also preferably has a relatively high density, which is desirable for good density-specific impulse performance. As an example, the liquid mixture has a preferred density of at least 1.1 grams per cubic centimeter, and most preferably greater than 1.25 grams per cubic centimeter. In one example, the liquid mixture has a density of 1.1 grams per cubic centimeter to 1.5 grams per cubic centimeter.

In further examples, the oxygen-containing solute or solvent is selected from carbohydrazide nitrate, ethylammonium nitrate, ethylene dihydrazine nitrate, hydroxyethylhydrazine, hydroxyethylhydrazinium nitrate, and combinations thereof.

The liquid mixture of the examples above may also contain additional additives, such as other solutes or solvents and/or oxidizer. For instance, the liquid mixture includes up to 98 mol % of water. In another example, the liquid mixture includes an oxidizer selected from ammonium nitrate, carbohydrazide nitrate, hydrazinium nitrate, hydroxylammonium nitrate, and combinations thereof. The liquid mixture may include the oxidizer at down to 0.5 equivalence ratio.

In a further example, the a liquid mixture includes water, an oxidizer selected from ammonium nitrate, carbohydrazide nitrate, hydrazinium nitrate, carbohydrazide nitrate, and combinations thereof, an unprotonated hydrazine selected from hydrazine, monomethylhydrazine, dimethylhydrazine, ethylhydrazine, and combinations thereof, and an oxygen-containing solute or solvent selected from carbohydrazide nitrate, ethylammonium nitrate, ethylene dihydrazine nitrate, hydroxyethylhydrazine, hydroxyethylhydrazinium nitrate, and combinations thereof. For instance, the liquid mixture includes:

20 mol % to 80 mol % of the unprotonated hydrazine,
10 mol % to 80 mol % of the oxygen-containing solute or solvent,
0 mol % to 20 mol % of the oxidizer, and
0 mol % to 20 mol % of the water.

The liquid mixtures herein generally have a density of 25% to 30% greater than hydrazine alone and a vapor toxicity (vapor pressure) that is 5% to 0.01% of hydrazine alone. Additionally, the liquid mixtures herein can be used under the same catalytic preheat conditions for rocket propellants as hydrazine and can be used with known nickel superalloy thruster designs (i.e., the liquid mixtures do not require use of high-cost refractory thrusters). The following compositions demonstrate further examples of the liquid mixture.

Example 1

70 mol % of hydrazine (N2H4),
30 mol % of hydroxyethylhydrazinium nitrate

Vapor pressure relative to neat hydrazine: 4%
Specific Impulse: 230 seconds
Density 1.24 g/cc
Reaction temperature: 910° C.
Viscosity: Approximately 13 cP at 20° C.

Example 2

65 mol % of hydrazine (N2H4),
25 mol % of hydroxyethylhydrazinium nitrate
10 mol % hydrazinium nitrate
Vapor pressure relative to neat hydrazine: 0.4%
Specific Impulse: 235 seconds
Density 1.28 g/cc
Reaction temperature: 1100° C.
Viscosity: Approximately 10 cP at 20° C.

Example 3

40 mol % of hydrazine (N2H4),
40 mol % of hydroxyethylhydrazinium nitrate
12 mol % hydrazinium nitrate
8 mol % of water
Vapor pressure relative to neat hydrazine: 0.04%
Specific Impulse: 235 seconds
Density 1.35 g/cc
Reaction temperature: 1100° C.
Viscosity: Approximately 31 cP at 20° C. Example 3:

Example 4

35.7 mol % of hydrazine (N2H4),
35.7 mol % of ethylammonium nitrate
21.5 mol % hydrazinium nitrate
7.1 mol % of water
Vapor pressure relative to neat hydrazine: 0.03%
Specific Impulse: 235 seconds
Density 1.29 g/cc
Reaction temperature: 1100° C.
Viscosity: Approximately 11 cP at 20° C.

Example 5

65 mol % of hydrazine (N2H4),
16 mol % of hydroxyethylhydrazinium nitrate
6.5 mol % ethylammonium nitrate
12.5 mol % hydrazinium nitrate
Vapor pressure relative to neat hydrazine: 0.4%
Specific Impulse: 235 seconds Example 6

51 mol % of hydrazine (N2H4),
23 mol % of ethylenedihydrazine nitrate
8 mol % hydrazinium nitrate
18 mol % of water
Vapor pressure relative to neat hydrazine: 0.3%
Specific Impulse: 235 seconds
Density 1.21 g/cc
Reaction temperature: 1040° C.
Viscosity: Approximately 16 cP at 20° C.

Example 7

56 mol % of hydrazine (N2H4),
18 mol % of carbohydrazide
24 mol % carbohydrazide nitrate
2 mol % of water
Vapor pressure relative to neat hydrazine: 0.2%
Specific Impulse: 232 seconds
Density 1.36 g/cc
Reaction temperature: 1140° C.
Viscosity: Approximately 24 cP at 20° C.

Example 8

51 mol % of hydrazine (N2H4),
22 mol % ethylammonium nitrate
23 mol % ammonium nitrate
4 mol % of water
Vapor pressure relative to neat hydrazine: 0.3%
Specific Impulse: 235 seconds
Density 1.27 g/cc
Reaction temperature: 1120° C.
Viscosity: Approximately 7 cP at 20° C.

Example 9

70 mol % of momomethylhydrazine,
70 mol % of monomethylhydrazine,
10 mol % ammonium nitrate
Vapor pressure relative to neat monomethylhydrazine: 1%
Specific Impulse: 205 seconds
Density 1.18 g/cc
Reaction temperature: 760° C.
Viscosity: Approximately 6 cP at 20° C.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from this disclosure. The scope of legal protection given to this disclosure can only be determined by studying the following claims.

What is claimed is:

1. A hydrazine-containing composition comprising:

a liquid mixture comprising from 5 mol % to 95 mol % of unprotonated hydrazine selected from a group consisting of hydrazine, monomethylhydrazine, dimethylhydrazine, ethylhydrazine, and combinations thereof, the unprotonated hydrazine having a first vapor pressure, and from 5 mol % to 90 mol % of at least one oxygen-containing solute or solvent having a second vapor pressure that is less than the first vapor pressure, the at least one oxygen-containing solute or solvent being selected from a group consisting of acetals, acetyls, alcoxyamines having two or more carbon atoms, aldehydes, amides, aminoalcohols, carbazides, semicarbazides, carbon-containing nitrate salts comprising cations with logarithmic dissociation constants greater than 9.2, hydroxyalkyl nitro compounds, hydroxyalkylhydrazines, carbonates, carboxylic acids and anhydrides of carboxylic acids, esters, ethers, ketals, ketones, mono- and poly-alcohols in 31% or greater mass fraction, nitrate esters, nitrosamines, sugars, and combinations thereof.

2. The composition as recited in claim 1, wherein the at least one oxygen-containing solute or solvent is selected from a group consisting of carbohydrazide nitrate, ethylammonium nitrate, ethylene dihydrazine nitrate, hydroxyethylhydrazine, hydroxyethylhydrazinium nitrate, bis(2-hydroxyethyl) hydrazine, bis(2-hydroxyethyl) hydrazinium nitrate, and combinations thereof.

3. The composition as recited in claim 2, wherein the liquid mixture includes up to 98 mol % water.

4. The composition as recited in claim 3, where in the liquid mixture includes an oxidizer selected from a group consisting of ammonium nitrate, carbohydrazide nitrate, hydrazinium nitrate, hydroxylammonium nitrate, and combinations thereof.

5. The composition as recited in claim 1, wherein the at least one oxygen-containing solute or solvent is selected from a group consisting of ethylammonium nitrate, hydroxyethylhydrazinium nitrate, and combinations thereof.

6. The composition as recited in claim 5, wherein the liquid mixture includes up to 98 mol % of water.

7. The composition as recited in claim 6, wherein the liquid mixture includes an oxidizer selected from a group consisting of ammonium nitrate, carbohydrazide nitrate, hydrazinium nitrate, hydroxylammonium nitrate, and combinations thereof.

8. The composition as recited in claim 1, wherein the at least one oxygen-containing solute or solvent is ethylammonium nitrate.

9. The composition as recited in claim 1, wherein the at least one oxygen-containing solute or solvent is hydroxyethylhydrazinium nitrate.

10. The composition as recited in claim 1, wherein the liquid mixture includes up to 98 mol % of water.

11. The composition as recited in claim 1, where in the liquid mixture includes an oxidizer.

12. The composition as recited in claim 11, wherein the oxidizer is selected from a group consisting of ammonium nitrate, carbohydrazide nitrate, hydrazinium nitrate, hydroxylammonium nitrate, and combinations thereof.

13. The composition as recited in claim 11, wherein the oxidizer is hydrazinium nitrate.

14. The composition as recited in claim 11, wherein the at least one oxygen-containing solute or solvent is selected from a group consisting of carbohydrazide nitrate, ethylammonium nitrate, ethylene dihydrazine nitrate, hydroxyethylhydrazine, hydroxyethylhydrazinium nitrate, bis(2-hydroxyethyl) hydrazine, bis(2-hydroxyethyl) hydrazinium nitrate, and combinations thereof.

15. The composition as recited in claim 14, wherein the liquid mixture includes up to 98% of water.

16. The composition as recited in claim 1, wherein the liquid mixture has a density of 1.1 grams per cubic centimeter to 1.5 grams per cubic centimeter.

17. The composition as recited in claim 1, wherein the second vapor pressure is less than the first vapor pressure by at least 50%.

18. A hydrazine-containing composition comprising:

a liquid mixture comprising water, an oxidizer selected from the group consisting of ammonium dinitramide, ammonium nitrate, carbohydrazide nitrate, hydrazinium nitrate, hydroxylammonium nitrate, and combinations thereof, unprotonated hydrazine selected from a group consisting of hydrazine, monomethylhydrazine, dimethylhydrazine, ethylhydrazine, and combinations thereof, and at least one oxygen-containing solute or solvent selected from a group consisting of carbohydrazide nitrate, ethylammonium nitrate, ethylene dihydrazine nitrate, hydroxyethylhydrazine, hydroxyethylhydrazinium nitrate, and combinations thereof.

19. The composition as recited in claim 18, wherein the liquid mixture includes:

20 mol % to 80 mol % of the unprotonated hydrazine, 10 mol % to 80 mol % of the oxygen-containing solute or solvent, 0 mol % to 20 mol % of the oxidizer, and 0 mol % to 20 mol % of the water.

20. The composition as recited in claim 19, wherein the oxidizer is hydrazinium nitrate, and the at least one oxygen-containing solute or solvent is selected a group consisting of ethylammonium nitrate and hydroxyethylhydrazinium nitrate, and combinations thereof.

21. A hydrazine-containing composition comprising:

a liquid mixture comprising from 5 mol % to 95 mol % of hydrazine having a first vapor pressure, and from 5 mol % to 90 mol % of at least one oxygen-containing solute or solvent having a second vapor pressure that is less than the first vapor pressure, the at least one oxygen-containing solute or solvent being selected from a group consisting of hydroxyethylhydrazinium nitrate, hydrazinium nitrate, and combinations thereof.

22. The composition as recited in claim 21, wherein the liquid mixture comprises 35.7 mol % to 70 mol % of the hydrazine, 16 mol % to 30 mol % of the hydroxyethylhydrazinium nitrate, and a non-zero amount to 20 mol % of the hydrazinium nitrate.

* * * * *